US007697704B2

(12) United States Patent
Brooks et al.

(10) Patent No.: US 7,697,704 B2
(45) Date of Patent: Apr. 13, 2010

(54) HEARING AID WITH A CURRENT LIMITER

(75) Inventors: Mark Brooks, København S (DK); Per Asbeck Nielsen, København N (DK)

(73) Assignee: GN Resound A/S (DK)

( * ) Notice: Subject to any disclaimer, the term of this patent is extended or adjusted under 35 U.S.C. 154(b) by 1056 days.

(21) Appl. No.: 11/389,275

(22) Filed: Mar. 23, 2006

(65) Prior Publication Data

US 2006/0233405 A1 Oct. 19, 2006

(30) Foreign Application Priority Data

Mar. 23, 2005 (DK) ..... 2005 00422

(51) Int. Cl.
*H04R 25/00* (2006.01)

(52) U.S. Cl. ..... 381/312; 381/323

(58) Field of Classification Search ..... 381/312, 381/315, 323

See application file for complete search history.

(56) References Cited

U.S. PATENT DOCUMENTS 4,543,453 A 9/1985 Brander
4,792,886 A 12/1988 Sahm
5,189,704 A 2/1993 Krauss

FOREIGN PATENT DOCUMENTS

EP 0 418 528 A1 3/1991
EP 1 282 340 A2 5/2003
WO WO 2004/034073 A1 4/2004

OTHER PUBLICATIONS

Office Action mailed Nov. 30, 2005 for Danish patent application PA 2005 00422, issued as Danish Patent No. PR 176789.
English Translated Office Action mailed Nov. 30, 2005 for Danish patent application PA 2005 00422, issued as Danish Patent No. PR 176789.
Office Action mailed Sep. 24, 2008 for Danish patent application PA 2005 00422, issued as Danish Patent No. PR 176789.
English Translated Office Action mailed Sep. 24, 2008 for Danish patent application PA 2005 00422, issued as Danish Patent No. PR 176789.
Office Action mailed Jun. 8, 2009 for Danish patent application PA 2005 00422, issued as Danish Patent No. PR 176789.
English Translated Office Action mailed Jun. 8, 2009 for Danish patent application PA 2005 00422, issued as Danish Patent No. PR 176789.

*Primary Examiner*—Brian Ensey
(74) *Attorney, Agent, or Firm*—Vista IP Law Group, LLP.

(57) ABSTRACT

A hearing aid having a microphone for conversion of sound into an input audiosignal, a signal processor for processing the input audiosignal, a receiver for conversion of the processed signal into sound, an audio amplifier for supplying current to the receiver in response to the processed signal, a battery for current supply of the signal processor, the audio amplifier, and the receiver, and a current limiter connected in series between the battery and the audio amplifier for analogue limitation of the current supplied by the battery to the audio amplifier in response to the battery output voltage.

12 Claims, 4 Drawing Sheets

HEARING AID WITH A CURRENT LIMITER

RELATED APPLICATION DATA

The present application claims benefit of priority to Danish Patent Application No. PA 2005 00422 filed on Mar. 23, 2005, the disclosures of which are incorporated herein by reference.

FIELD

The present application relates to hearing aids, in particular to hearing aids with a current limited output from the battery of the hearing aid.

BACKGROUND

Today's modern hearing aids typically include electronic circuits driving an audio amplifier, which in turn drives a receiver to generate sound into the ear of the user. The electronic circuits and the amplifier are both powered from a battery. Typically, the electronics inside the hearing aid is a combination of digital and analogue circuitry. Such a hearing aid is illustrated in FIG. 1.

With reference to FIG. 1, when the audio amplifier 20 drives the receiver 16 to produce sound, large currents 22 may flow from the battery 24. Because of the impedance 25 of the battery 24, the large currents 22 result in voltage fluctuations on the battery supply line 28 as shown in FIG. 2.

The battery voltage fluctuations appear also on the supply terminals to the hearing aid electronics. Unfortunately the hearing aid electronics will always have a threshold 38 below which the circuitry is not guaranteed to work. This is also shown in FIG. 2. Below the indicated threshold 38 for example analogue circuit cannot be guaranteed to operate as intended, and digital processors/state machines etc. may malfunction or crash at time 40 in FIG. 2.

Because of the limited internal volume for accommodation of electronic components in a hearing aid, typically, there is not sufficient space available for a decoupling capacitor large enough to supply the audio amplifier during output transients.

In WO 2004/034073, a method of current management in a battery powered device is disclosed. The method comprises the steps of comparing the actual supply voltage with a reference, generating a control signal when the supply voltage is below the reference, use the control signal to reduce the load current by disconnection of the load whereby the supply voltage increases, and repeat the previous steps as long as the supply voltage is below the reference voltage. The current limitation is a sampled current limitation. Although the sampling frequency is well above the audible range, frequency convolution may lead to audible deterioration of the output sound due to the time discrete nature of the current limitation.

Thus, there is a need for a hearing aid wherein voltage drops caused by sound amplification is avoided with less deterioration of the sound quality.

SUMMARY

According to some embodiments, the above-mentioned and other objects are fulfilled by a hearing aid comprising a microphone for conversion of sound into an input audiosignal, a signal processor for processing the input audiosignal, a receiver for conversion of the processed signal into sound, an audio amplifier for supplying current to the receiver in response to the processed signal, and a battery for current supply of the signal processor, the audio amplifier, and the receiver, and wherein the hearing aid further comprises a current limiter connected in series between the battery and the audio amplifier for analogue limitation of the current supplied by the battery to the audio amplifier in response to the battery output voltage.

The battery may be of any type suitable for power supplying a hearing aid, including a rechargeable battery, a non-rechargeable battery, a battery with a high output voltage connected to a voltage converter converting the battery voltage to a voltage suitable for supplying the circuitry of a hearing aid.

The current limitation is performed continuously in time in that the series resistance of the current limiter may attain any value of a continuous range of values resulting in the desired current limitation. The current limiter does not operate as a switching current limiter that alternately connects and disconnects the audio amplifier to and from the battery, the duty cycle of the switching providing the desired current limitation.

Thus, according to some embodiments, a voltage controlled current limiter is inserted in the supply to the audio amplifier whereby the battery voltage is monitored and if the voltage drops to an unsafe level, the current to the audio amplifier is limited so that the voltage is prevented from dropping further.

The audio amplifier current limit protection provided is useful in a hearing aid wherein the battery voltage is typically only slightly larger than what is required by the hearing aid electronics for proper operation. The current limiter according to the embodiments operates to prevent the supply voltage from dropping below the minimum operating voltage required. When the battery voltage is sufficient for proper operation of the hearing aid electronics, the current limiter remains inactive and does not interfere with the output audiosignal generated for the receiver.

It is an important advantage that the hearing aid electronics is protected against high power audio output transients.

BRIEF DESCRIPTION OF THE DRAWINGS

The above and other features and advantages will become more apparent to those of ordinary skill in the art by describing in detail exemplary embodiments thereof with reference to the attached drawings in which.

DETAILED DESCRIPTION OF EMBODIMENTS

Figure 1:
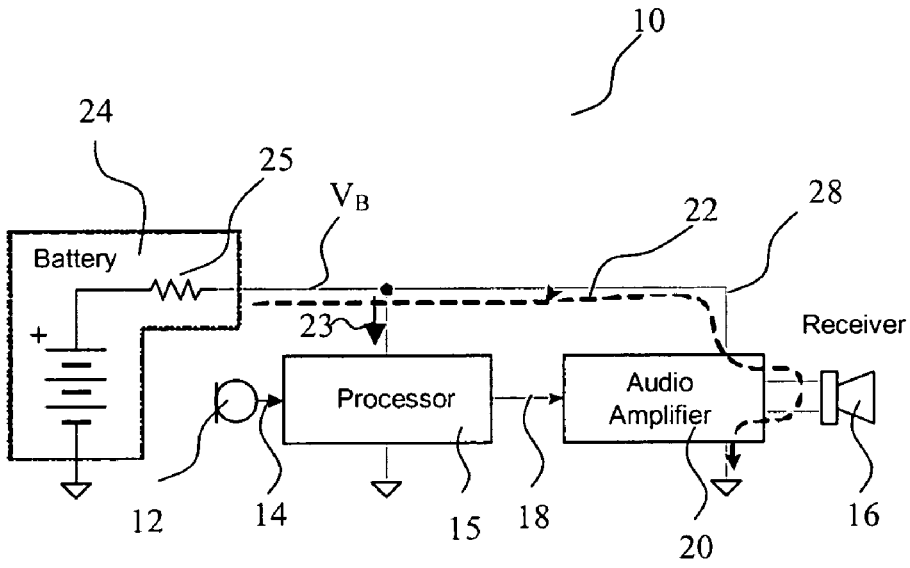
(Prior art) Fig. 1
FIG. 1 schematically illustrates a known hearing aid.
Figure 2:
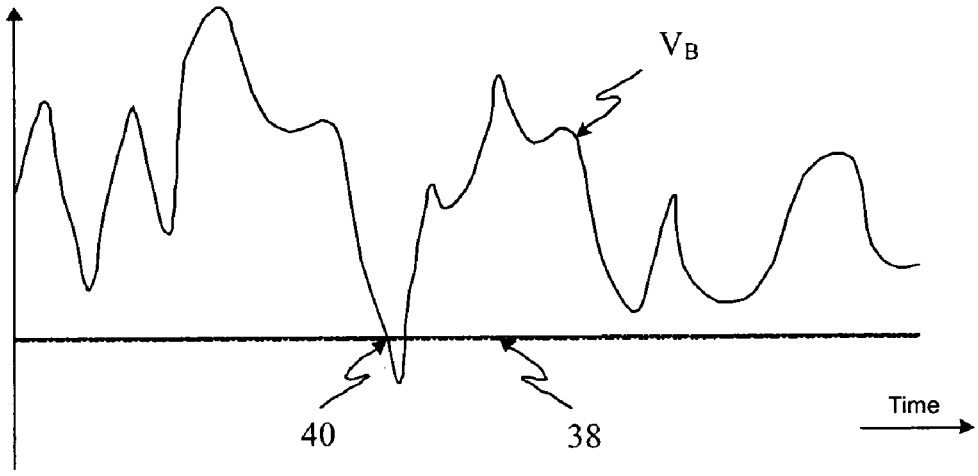
(Prior art) Fig. 2
FIG. 2 is a plot of the battery voltage as a function of time in a known hearing aid.

The present embodiments will now be described more fully hereinafter with reference to the accompanying drawings, in which exemplary embodiments are shown. The embodiments may, however, be embodied in different forms and should not be construed as limited to the embodiments set forth herein. Rather, these embodiments are provided so that this disclosure will be thorough and complete. Like reference numerals refer to like elements throughout.

Figure 3:
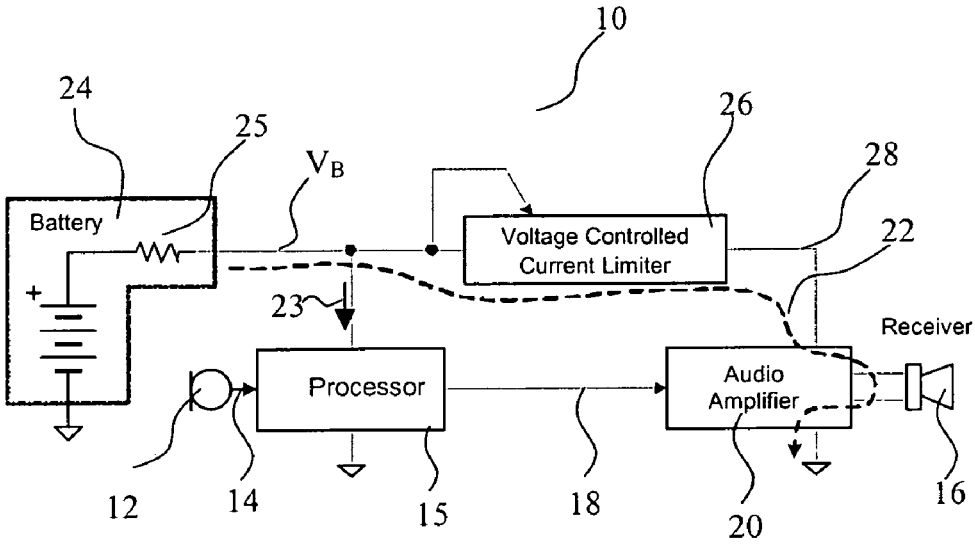
FIG. 3 is a blocked diagram of an embodiment.

FIG. 3 is a blocked schematic of a hearing aid 10 according to some embodiments, comprising a microphone 12 for conversion of sound into an input audiosignal 14, a signal processor 15 for processing the input audiosignal 14, a receiver 16 for conversion of the processed signal 18 into sound, an audio amplifier 20 for supplying current 22 to the receiver 16 in response to the processed signal 18. A battery 24 supplies current 23 to the signal processor 15, and current 22 to the audio amplifier 20 and the receiver 16. A current limiter 26 performs analogue limitation of the current 26 supplied by the battery 24 in response to the battery output voltage $V_B$.

Thus, according to some embodiments, a voltage controlled current limiter 26 is inserted in the supply line 28 to the audio amplifier 20 so that the battery voltage $V_B$ is monitored. If the voltage $V_B$ drops to a predetermined level, the current 22 to the audio amplifier 20 is limited so that the voltage $V_B$ is prevented from dropping further. Hereby, the hearing aid electronics is protected against audio output transients.

Figure 4:
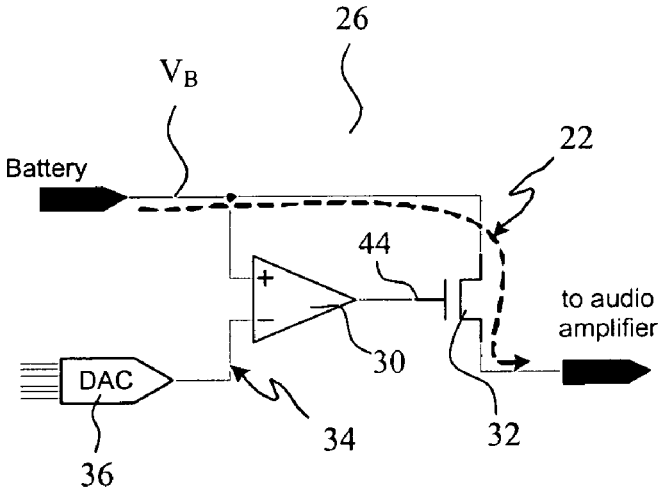
FIG. 4 is a circuit diagram of a current limiter according to some embodiments.

FIG. 4 shows a circuit diagram of a voltage controlled current limiter 26 comprising a control circuit 30, in the illustrated example an operational amplifier 30, with a control output 44 controlling the gate voltage of transistor 32. A limiter reference voltage level 34 is provided at one of the inputs. The reference voltage may be a fixed voltage, or, the reference voltage may be adjustable using a software controlled digital to analogue converter 36. The operational amplifier 30 senses the battery voltage $V_B$. When the voltage $V_B$ is above the reference voltage 34, the control circuit 30 controls the gate voltage so that the transistor 32 short-circuits and conducts current, and current 22 may flow unobstructed through the audio amplifier 20 and receiver 16. When the voltage drops below the reference voltage 34, the control circuit 30 controls the gate voltage so that the transistor 32 increases its resistance thereby limiting the current 22 to the audio amplifier 20.

Figure 5:
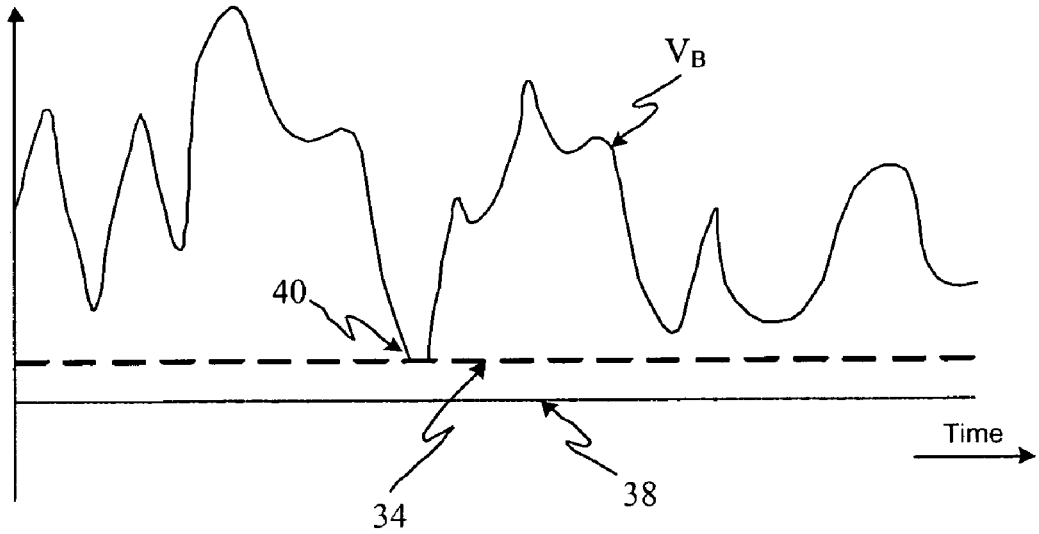
FIG. 5 is a plot of the battery voltage as a function of time in a hearing aid according to some embodiments.

The current limiter operates as a feedback control loop that prevents the battery voltage $V_B$ from decreasing below the reference voltage 34 as illustrated in the plot of battery voltage $V_B$ as a function of time in FIG. 5. Preferably, the reference voltage is set with a safety margin above the minimum supply voltage 38 tolerated by the hearing aid electronic circuitry. Thus, malfunctioning or even crashing of the protected circuitry is avoided.

The hearing aid may further be designed for controlling the gain of the audio amplifier in response to the battery voltage. For example during the initial part of an output sound transient, the current limiter may be active limiting current for the audio amplifier so that the voltage supplying other hearing aid circuitry is kept above a critical level maintaining proper operation of this circuitry. Then, the gain of the audio amplifier may be decreased with a longer time constant until the current limiter ceases current limiting.

Figure 6:
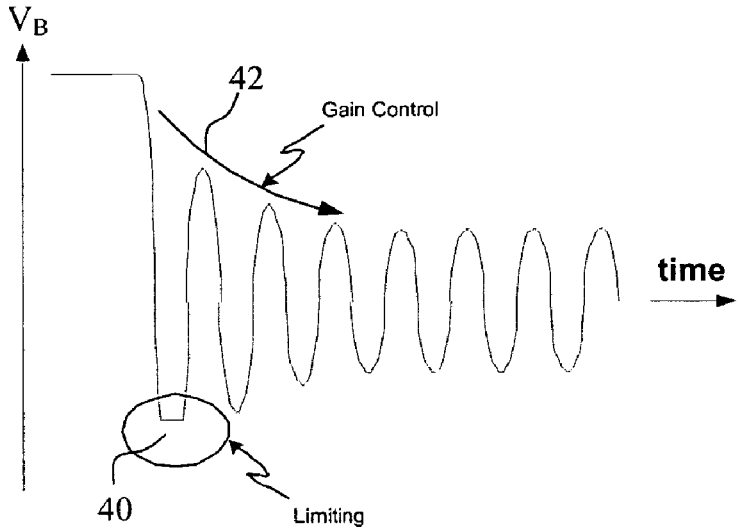
FIG. 6 is a plot of the battery voltage as a function of time in another hearing aid according to some embodiments.

This is further illustrated in the plot of FIG. 6 wherein the hearing aid is further designed for co-operation between the current limiter and the audio amplifier 20 of the hearing aid. The output 44 of the control circuit 30 shown in FIG. 4 may be connected to a gain control input of the audio amplifier 20 shown in FIG. 3 for decreasing the gain of the audio amplifier when the battery voltage $V_B$ drops below the reference voltage 34. Preferably, the gain is decreased with a longer time constant than the current limitation.

For example during the initial part of an output sound transient, the current limiter is active at reference numeral 40 limiting current for the audio amplifier so that the voltage $V_B$ supplying other hearing aid circuitry is kept above a critical level maintaining proper operation of this circuitry. Then, the gain control circuit decreases the gain with a long time constant indicated at reference numeral 42 until the current limiter ceases current limiting.

Figure 7:
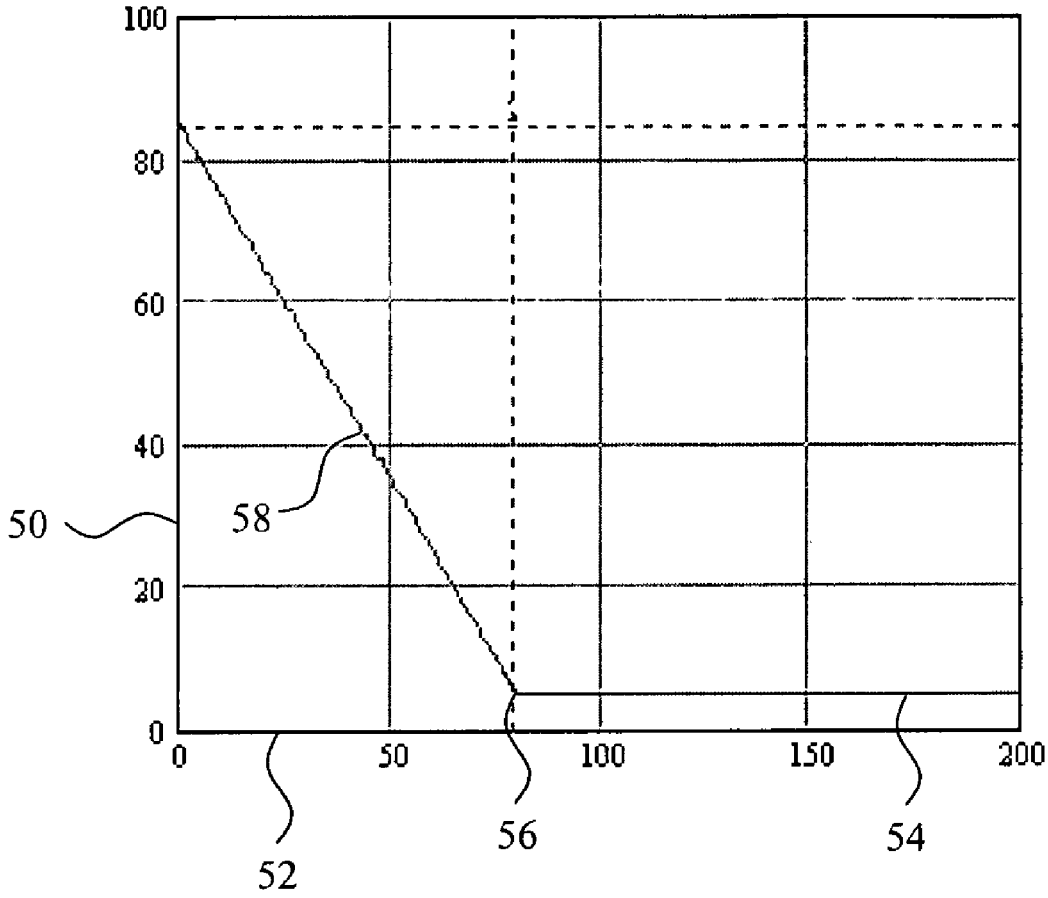
FIG. 7 is a plot of the series resistance of the current limiter illustrated in FIGS. 3 and 4 as a function of a load resistance.

FIG. 7 is a plot of the series resistance of the current limiter 26 illustrated in FIGS. 3 and 4 as a function of a load resistance. The series resistance of the current limiter 26 is plotted against the y-axis 50 and the load resistance is plotted against the x-axis 52.

It should be noted that the illustrated current limiter 26 operates in an active state and a passive state.

In the passive state, the battery voltage $V_B$ is larger than the reference voltage 34 so that the control output voltage 44 to the transistor 32 is high and well above the turn on threshold voltage of the transistor. Thus, the transistor is turned fully on and conducts current with a minimum series resistance and a minimum influence on the supply voltage and current to the audio amplifier 20. In this state, the current limiter control loop is open and there is no feedback. As long as the battery voltage stays above the reference voltage 34, the control voltage 44 remains unchanged.

When the battery voltage $V_B$ decreases to the reference voltage 34, the current limiter 26 enters its active state wherein the current limiter control loop closes and the control output voltage 44 is adjusted so that the current limiter series resistance is increased until the required minimum battery voltage $V_B$ is restored, i.e. the sum of the load resistance and the current limiter series resistance is kept constant whereby a constant current is drawn from the battery.

This is illustrated by the plotted graph in FIG. 7. The horizontal part 54 of the plotted curve shows the current limiter series resistance in the passive state. The load resistance is high and the battery voltage $V_B$ is kept above the reference voltage 34. Decreasing the load resistance increases the current drawn from the battery 24 whereby the battery voltage $V_B$ decreases and at the knee-point 56 the battery voltage $V_B$ has reached the reference voltage 34, and the current limiter 26 enters its active state. In the active state, the control loop controls the resistance of the current limiter 26 in such way that the sum of the series resistances of the current limiter and the load is constant illustrated by the straight line 58 with a slope equal to minus one. Thus, the total resistance is kept constant whereby the battery voltage is kept constant at the required minimum supply voltage.

The sharp transition 56 between the active state and the passive state of the current limiter 26 is due to a high gain in the amplifier 30. A low gain would create a smooth transition between the two states. A sharp transition between the two states leads to substantially no influence on the resulting supply voltage and current to the load when the battery voltage is larger than or equal to the reference voltage 34.

The invention claimed is:

1. A hearing aid comprising:

a microphone for conversion of sound into an input audio signal, a signal processor for processing the input audio signal, a receiver for conversion of the processed input audio signal into sound, an audio amplifier for supplying current to the receiver in response to the processed input audio signal, a battery for current supply of the signal processor, the audio amplifier, and the receiver, and a current limiter connected in series between the battery and the audio amplifier for analogue limitation of the current supplied by the battery to the audio amplifier in response to an output voltage of the battery.

2. The hearing aid according to claim 1, wherein the current limiter limits the current supplied by the battery to the audio amplifier when the output voltage drops below a specific threshold voltage.

3. The hearing aid according to claim 2, wherein the threshold voltage is programmable.

4. The hearing aid according to claim 1, further comprising a control circuit for decreasing a gain of the audio amplifier in response to the output voltage of the battery.

5. The hearing aid according to claim 2, further comprising a control circuit for decreasing a gain of the audio amplifier in response to the output voltage of the battery.

6. The hearing aid according to claim 3, further comprising a control circuit for decreasing a gain of the audio amplifier in response to the output voltage of the battery.

7. A hearing aid comprising:

a microphone for conversion of sound into an input audio signal, a signal processor for processing the input audio signal, a receiver for conversion of the processed input audio signal into sound, an audio amplifier for supplying current to the receiver in response to the processed input audio signal, a battery means for current supply of the signal processor, the audio amplifier, and the receiver, and a current limiting means connected in series between the battery means and the audio amplifier for analogue limitation of the current supplied by the battery means to the audio amplifier in response to an output voltage of the battery means.

8. The hearing aid according to claim 7, wherein the current limiting means limits the current supplied by the battery means to the audio amplifier when the output voltage drops below a specific threshold voltage.

9. The hearing aid according to claim 8, wherein the threshold voltage is programmable.

10. The hearing aid according to claim 7, further comprising a control circuit for decreasing a gain of the audio amplifier in response to the output voltage of the battery means.

11. The hearing aid according to claim 8, further comprising a control circuit for decreasing a gain of the audio amplifier in response to the output voltage of the battery means.

12. The hearing aid according to claim 9, further comprising a control circuit for decreasing a gain of the audio amplifier in response to the output voltage of the battery means.

* * * * *